United States Patent [19]

Kim

[11] Patent Number: 4,614,081

[45] Date of Patent: Sep. 30, 1986

[54] METHOD FOR MANUFACTURING A COTTON YARN

[75] Inventor: Ki W. Kim, Seoul, Rep. of Korea

[73] Assignee: Youngnam Textile Co., Ltd., Seoul, Rep. of Korea

[21] Appl. No.: 660,006

[22] Filed: Oct. 11, 1984

[51] Int. Cl.[4] ..... D02G 3/36; D02G 3/38

[52] U.S. Cl. ..... 57/12; 57/6; 57/210

[58] Field of Search ..... 57/3, 6, 12, 13, 210, 57/224–229

[56] References Cited

U.S. PATENT DOCUMENTS

| | | | |
|---|---|---|---|
| 2,210,884 | 8/1940 | Chittenden et al. | 57/12 |
| 2,859,583 | 11/1958 | Parker | 57/12 |
| 2,990,673 | 7/1961 | Adkins, Jr. | 57/12 |
| 3,199,283 | 8/1965 | Livingston | 57/12 X |
| 3,243,950 | 4/1966 | Hermes | 57/12 |
| 3,334,478 | 8/1967 | Milne | 57/12 |
| 3,410,080 | 11/1968 | Lord, Jr. et al. | 57/12 |
| 3,489,368 | 1/1970 | Rehwald | 57/12 X |
| 3,596,458 | 8/1971 | Nakano et al. | 57/12 X |

*Primary Examiner*—John Petrakes

*Attorney, Agent, or Firm*—Birch, Stewart, Kolasch & Birch

[57] ABSTRACT

A method for manufacturing a cotton core yarn which comprises introducing a tension into a core yarn, and bringing a cotton yarn together with the core yarn, said core yarn having a higher tension than that of the cotton yarn and said cotton yarn being supplied at a higher speed than that of the core yarn, whereby the core yarn forms the center fiber and the cotton yarn uniformly covers the surface of the core yarn.

8 Claims, 3 Drawing Figures

METHOD FOR MANUFACTURING A COTTON YARN

BACKGROUND OF THE INVENTION

The present invention relates to a method for manufacturing a cotton core yarn, and more particularly, to an improved method of providing a core yarn made of a synthetic material with a surface yarn made of a natural fiber material.

Methods for manufacturing cotton core yarn are well-known in the art. FIGS. 2 and 3 show typical methods of producing these types of yarn. Thus, FIG. 2 shows a core yarn 90 which is being introduced to the nip point 100 between a pair of opposing rollers 80,80 where the core yarn 90 is combined with a cotton yarn 10. The cotton yarn 10 passes through apron 30, opposing rollers 20, and opposing conveyors 40 and 50 before being combined with the core yarn 90 at the nip point 100 between opposing rollers 80. The conveying means 40 and 50 include conveyor belts rotatably disposed on rollers 60 and 70. Since the prior art device of FIG. 2 does not contain a means for applying a constant tension to the core yarn, difficulties are encountered in uniformly covering the core yarn with the cotton yarn and accordingly, the cotton yarn surface cannot be uniformly applied to the core yarn, thereby leaving open spaces along the core yarn. When the core yarn combines with the cotton yarn, it is twisted and then transferred by a winding device 110 to a supply bobbin 120 through the utilization of winding head 130.

FIG. 3 represents another type of prior art device wherein a core yarn 90 is fed to a core guide 140 where it is brought together with cotton yarn which is conveyed through apron 30 and opposing rollers 20 to the core guide. The composite yarns are then conveyed between the opposing surfaces of the conveying means 40 and 50 and then introduced at the nip point 100 between opposing rollers 80. However, this prior art system provides the core yarn with an uneven draft of covered cotton fiber and accordingly, the cotton yarn is not applied uniformly to the core yarn, leaving bare spots along the core yarn and other areas of excessive amounts of cotton yarn exposed on the core yarn. Thus, the core yarn is provided with a very irregular surface of cotton fibers. The device of FIG. 3 can be found in Korean Pat. No. 3772 published in Patent Gazette No. 233, pp. 117–119.

The Japanese Patent Gazette SO44-22788 and Japanese Patent Gazette SO47-18055 disclose a method for preparing cotton core yarn and a method for preparing an elastic core yarn, respectively. However, both of these prior art devices disclose methods wherein the surface cotton yarn cannot be uniformly disposed on the core yarn.

In all of the prior art devices discussed hereinabove, the cotton yarns must be spun before they are used and the spinning process is an indispensible step in combining the cotton yarn with a core yarn. Thus, it is necessary to use the additional spinning or coiling apparatus or a device which places a fancy twist in the fiber.

Accordingly, it is an object of the present invention to provide an improved method for manufacturing a cotton core yarn of good quality.

Another object of the present invention is to provide an improved method for providing a cotton core yarn wherein the core yarn is uniformly and completely covered with the cotton yarn.

Yet another object of the present invention is to provide a method for manufacturing a cotton core yarn wherein a tension is placed in the core yarn to compensate for the weaknesses which are inherently present in the core yarn. Still another object of the present invention is to provide a cotton core yarn which can be uniformly and readily dyed.

A further object of the present invention is to provide a method for manufacturing a cotton core yarn which is more inexpensive than the conventional methods and the cotton core yarn product is similar to fancy twisted yarn since the cotton core yarn can be similarly twisted.

Other objects and further scope of applicability of the present invention will become apparent from the detailed description hereinafter. It should be understood, however, that the detailed description and specific examples, all indicate preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
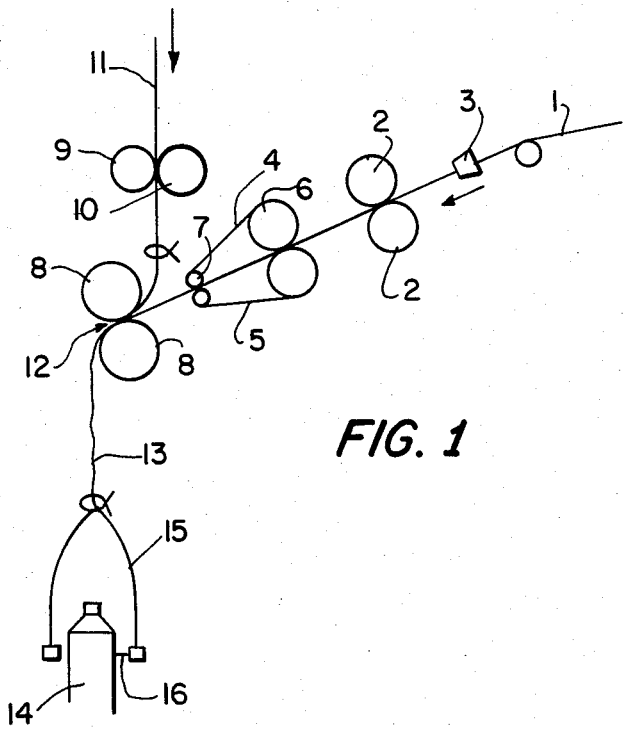
FIG. 1 shows a method for manufacturing cotton core yarn in accordance with the present invention.
Figure 2:
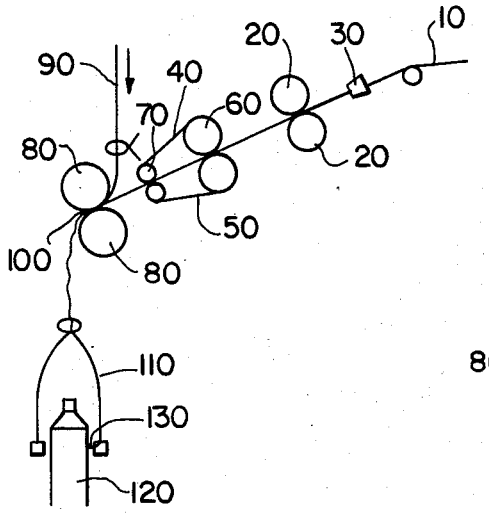
PRIOR ART FIG. 2
FIG. 2 represents a prior art method for manufacturing cotton core yarn.
Figure 3:
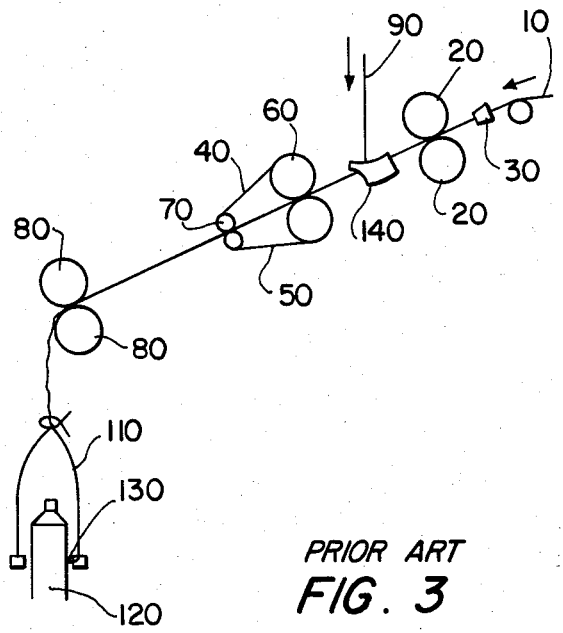
PRIOR ART FIG. 3
FIG. 3 represents another prior art method for manufacturing cotton core yarn.

The present invention will now be described in greater detail by referring to FIG. 1 of the drawings. FIG. 1 shows roving cotton yarn 1 and tensioned core yarn 11 which are supplied together to the nip point 12 between a pair of opposing rollers 8,8. The core yarn 11 is tensioned between tension rollers 9 and 10 and accordingly, possesses a stronger tension than that of the cotton roving yarn 1. Also, the cotton roving yarn 1 is introduced to the nip point 12 at a higher speed than that of the core yarn 11. When the tension core yarn and the cotton roving yarn are properly combined together, that is, with the former being tensioned and the latter being supplied at a higher speed, the core yarn 11 is positioned inside the center of the cotton roving yarn 1. In order to obtain sufficient and even coverage of the cotton fibers around the tensioned core yarn, advantageously, the core yarn 11 is provided with a tension in the range of about 1.5 to 4.0 g/d at the nip point 12. Furthermore, the covering cotton yarn 1 must be fed to the nip point 12 at a higher speed than that of the core yarn 11 and advantageously the speed of the core yarn to the covering cotton yarn is in the ratio of 1:1.02 to 1:1.6. Thus, in order to obtain a desirable cotton covering effect, the conditions of tension in the core yarn and the introduction of a higher quantity of cotton yarn at the nip point of the rollers should exist together. Thus, when the tension of the core yarn is less than about 1.5 g/d, the core yarn tends to deviate from the center of the cotton yarn and it shows the same effect of the fancy twisted yarn of the prior art. When the tension of the core yarn 11 is higher than about 5.0 g/d, the core yarn tends to break or slip. Also, when the overfeed of the cotton yarn is less than the above range, insufficient cotton coverage is produced and accordingly, surfaces of the core yarn are exposed between the cotton fibers. When the overfeed of the cotton yarn is beyond the above range, the surface of the cotton fibers along the core yarn is irregular and not uniform. However, when the core yarn and the cotton covering yarn are combined together within the parameters discussed hereinabove, the core yarn is positioned properly in the middle of the surrounding cotton yarn and the cotton yarn covers the core yarn, both completely and uniformly. Such an effective covering of the core yarn with the cotton yarn facilitates the subsequent dyeing of the cotton core yarn composite.

According to the present invention, it is possible to make cotton roving yarn like cotton spun yarn with one cotton spinning frame. For obtaining the desired tension of the core yarn, according to the present invention, the core yarn 11 is tensioned between a pair of tension rollers 9 and 10 with tension roller 9 being provided with a rubber surface and tension roller 10 being provided with a metal surface. Of course, other tension devices can be utilized in place of the tension rollers since it should be recognized that it is only important that the tension should be placed in the core yarn within a specific range. As shown in FIG. 1, the cotton yarn is guided through element 3 between a pair of feed rollers 2,2 and between conveying means or apron means 4 and 5 to the nip point 12 disposed between opposing rollers 8,8. The opposing apron means 4 and 5 comprise belt means rotatably disposed on roller means 6 and 7, respectively. The tension of the core yarn which is introduced into the yarn between rollers 9 and 10 must be maintained within the desired range even at the nip point 12 and winding device 16. Advantageously, roller 9 which contains the rubber surface, functions as a tension roller and roller 10 which has a metal surface functions as the driving roller, whereby the driving roller is placed into contact with the tension roller, with a certain pressure being applied to the tension roller 9, causing the rollers to rotate together.

According to the present invention, the core yarn is made of a synthetic polymeric material, such as, for example, a polyamide synthetic material, for example, nylon, or a polyester filament yarn. The yarn which is utilized to surround the core yarn is made of a natural fiber, such as, for example, a cotton yarn fiber. The synthetic fiber core yarn is strong and thus reinforces the weakness of the cotton yarn, whereas the cotton fibers of the cotton yarn is easier to dye.

According to the present invention, one of the reasons why the core yarn is provided with a particular tension is to cause a certain degree of slip between the opposing rollers 8,8 whereby the core yarn 11 is more readily centered within the fleece-like cotton roving yarn 1. After the core yarn is properly covered with the cotton yarn, the resulting cotton core yarn is wound by a winding device 15 and 16 onto a bobbin 14.

As an example of the present invention, 100*d* of a polyester filament yarn, for example, polyethylene terephthalate, as a core yarn was introduced together with cotton roving yarn between tension rollers which are pressing against each other at a pressure of 1 kg/cm. A tension of 3.1 g/d is introduced into the polyethylene terephthalate core yarn. The cotton yarn is combined with the core yarn at a ratio of core yarn to cotton yarn of 1:1.10. The composite final product shows about 7 to 8 U% which is to be compared with the conventional value of about 11 to 12 U% of a polyester/cotton mixed yarn.

The invention being thus described, it will be obvious that the same may be varied in many ways. Such variations are not to be regarded as a departure from the spirit and scope of the invention, and all such modifications as would be ovious to one skilled in the art are intended to be included in the scope of the following claims.

What is claimed:

1. A method for manufacturing a cotton core yarn which comprises:

introducing a tension into a core yarn, and bringing a cotton yarn together with the core yarn prior to being passed through opposing roller means, said core yarn having a higher tension than that of the cotton yarn and said cotton yarn being supplied to the core yarn at opposing roller means at a higher speed than that of the core yarn, said tension being applied to the core yarn within the range of about 1.5 to 4.0 g/d and the cotton yarn being supplied at a speed to be combined with the core yarn in a ratio of core yarn to the cotton yarn of about 1:1.02 to 1:1.60 whereby the core yarn forms the center fiber and the cotton yarn uniformly covers the surface of the core yarn.

2. The method of claim 1 where tension is introduced into the core yarn by passing the core yarn through the nip of opposing rubber surface tension roller and meta surface tension roller.

3. The method of claim 2 wherein the pressure of the rubber surface tension roller against the metal surface tension roller is 0.5 to 1.5 kg/cm.

4. The method of claim 3 wherein the pressure of the tension rollers is 1 kg/cm.

5. The method of claim 1 wherein the cotton yarn is brought together with the core yarn by being introduced at the nip between opposing rollers.

6. The method of claim 1 wherein the core yarn is twisted prior to being combined with the cotton yarn.

7. The method of claim 1 wherein the core yarn is made of synthetic fibers and the cotton yarn is made of natural fibers.

8. The method of claim 1 wherein the cotton core yarn thus produced is twisted and wound on a bobbin.

* * * * *